US009592687B2

(12) United States Patent
Yoshiike

(10) Patent No.: US 9,592,687 B2
(45) Date of Patent: Mar. 14, 2017

(54) HEAD DEVICE, APPARATUS INCORPORATING THE HEAD DEVICE, LIQUID DISCHARGE DEVICE, AND APPARATUS FOR DISCHARGING LIQUID

(71) Applicant: Masataka Yoshiike, Kanagawa (JP)

(72) Inventor: Masataka Yoshiike, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/873,744

(22) Filed: Oct. 2, 2015

(65) Prior Publication Data

US 2016/0096386 A1 Apr. 7, 2016

(30) Foreign Application Priority Data

Oct. 2, 2014 (JP) ..... 2014-203635
Jul. 25, 2015 (JP) ..... 2015-147276

(51) Int. Cl.
*B41J 2/14* (2006.01)
*B41J 25/34* (2006.01)

(52) U.S. Cl.
CPC ..... *B41J 25/34* (2013.01); *B41J 2/14201* (2013.01); *B41J 2/14274* (2013.01)

(58) Field of Classification Search
CPC ..... B41J 2/14201; B41J 2/14274; B41J 25/34
See application file for complete search history.

(56) References Cited

U.S. PATENT DOCUMENTS

2004/0189757 A1* 9/2004 Yamada ..... B41J 2/14209 347/86
2006/0028519 A1* 2/2006 Nakamura ..... B41J 2/17523 347/87
2013/0182040 A1 7/2013 Kinokuni et al.
2013/0187991 A1* 7/2013 Watanabe ..... B41J 2/14274 347/71
2013/0208047 A1 8/2013 Yoshiike

FOREIGN PATENT DOCUMENTS

JP 9-277530 10/1997
JP 10-109418 4/1998
JP 10-264396 10/1998
JP 11-320880 11/1999
JP 2004-195689 7/2004

* cited by examiner

*Primary Examiner* — Manish S Shah
*Assistant Examiner* — Yaovi M Ameh
(74) *Attorney, Agent, or Firm* — Cooper & Dunham LLP

(57) ABSTRACT

A head device includes a head and a head holder. The head includes a reference face, a first opposing face, and a second opposing face. The head holder is joined to the head. The head holder includes a reference face contacting the reference face of the head, a first opposing face opposing the first opposing face of the head to form a first space, and a second opposing face opposing the second opposing face of the head to form a second space. The second space is smaller than the first space in a mounting direction in which the reference face of the head is brought into contact with the reference face of the head holder. The head is joined to the head holder with adhesive filled in each of the first space and the second space.

16 Claims, 12 Drawing Sheets

HEAD DEVICE, APPARATUS INCORPORATING THE HEAD DEVICE, LIQUID DISCHARGE DEVICE, AND APPARATUS FOR DISCHARGING LIQUID

CROSS-REFERENCE TO RELATED APPLICATIONS

This patent application is based on and claims priority pursuant to 35 U.S.C. §119(a) to Japanese Patent Application Nos. 2014-203635, filed on Oct. 2, 2014, and 2015-147276, filed on Jul. 25, 2015, in the Japan Patent Office, the entire disclosure of each of which is hereby incorporated by reference herein.

BACKGROUND

Technical Field

Aspects of the present disclosure relate to a head device, an apparatus incorporating the head device, a liquid discharge device, and an apparatus for discharging liquid.

Description of the Related Art

An image forming apparatus may include a head device in which a head (also referred to as head chip) is held on a head holder by joining with adhesive.

For example, an inkjet head device includes an inkjet head having a function of discharging ink, a base substrate on which the inkjet head is fixed, an abutment part at which the inkjet head contacts the base substrate, and an adhesion portion at which the inkjet head is joined to the base substrate with adhesive at a position different from the abutment part.

To obtain a sufficient joining strength when the head and the head holder are fixed with adhesive, for example, the head and the head holder are positioned and temporarily fixed, and then fixed with an adhesive capable of providing a greater joining strength.

SUMMARY

In an aspect of this disclosure, there is provided a head device that includes a head and a head holder. The head includes a reference face, a first opposing face, and a second opposing face. The head holder is joined to the head. The head holder includes a reference face contacting the reference face of the head, a first opposing face opposing the first opposing face of the head to form a first space, and a second opposing face opposing the second opposing face of the head to form a second space. The second space is smaller than the first space in a mounting direction in which the reference face of the head is brought into contact with the reference face of the head holder. The head is joined to the head holder with adhesive filled in each of the first space and the second space.

In an aspect of this disclosure, there is provided an apparatus that includes the head device.

In an aspect of this disclosure, there is provided a liquid discharge device including the head device. The head of the head device is a liquid discharge head to discharge liquid. The head device is integrated with at least one of a head tank to store the liquid to be supplied to the liquid discharge head of the head device, a carriage mounting the liquid discharge head, a supply unit to supply the liquid to the liquid discharge head, a maintenance unit to maintain and recover the liquid discharge head, and a main scan moving unit to move the liquid discharge head in a main scanning direction.

In an aspect of this disclosure, there is provided an apparatus for discharging liquid. The apparatus includes the liquid discharge device.

In an aspect of this disclosure, there is provided an apparatus for discharging liquid. The apparatus includes the head device. The head of the head device is a liquid discharge head to discharge liquid.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
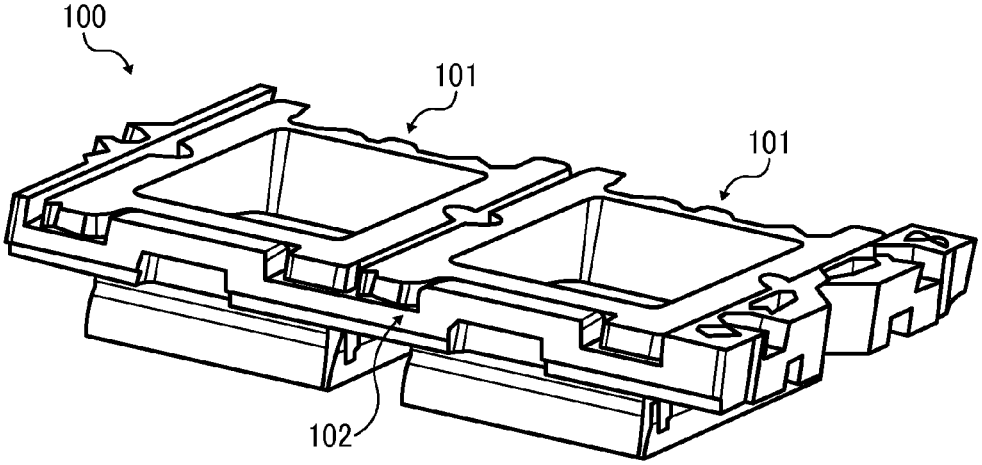
FIG. 1 is a perspective view of an example of a head device according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Figure 2:
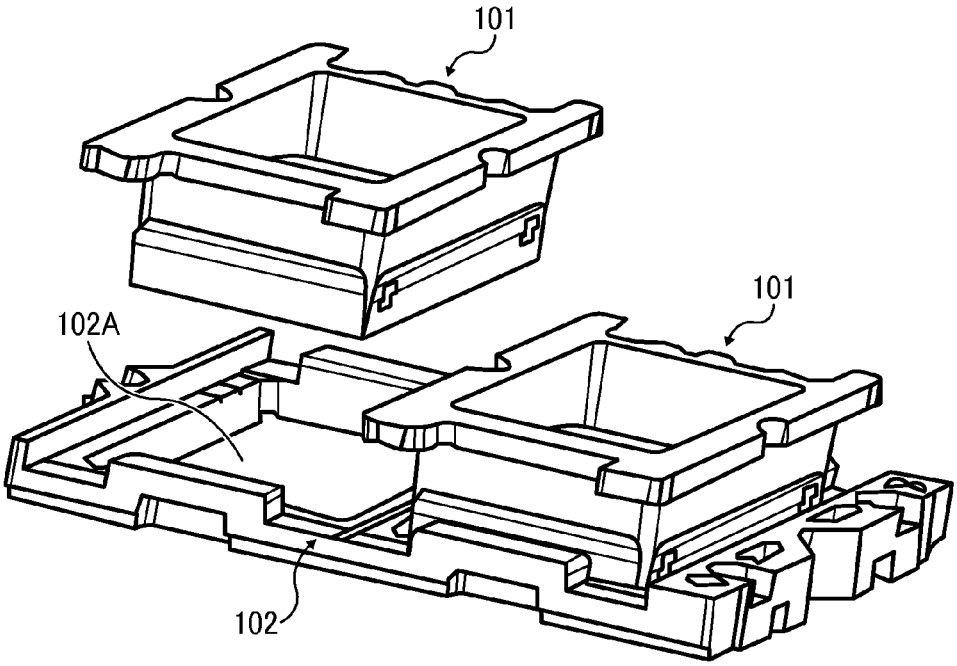
FIG. 2 is an exploded perspective view of the head device of FIG. 1.

Hereinafter, embodiments of the present disclosure are described with reference to the attached drawings. First, a head device according to an embodiment of this disclosure is described with reference to FIGS. 1 and 2. FIG. 1 is a perspective view of a head device according to an embodiment of this disclosure. FIG. 2 is an exploded perspective view of the head device of FIG. 1.

A head device 100 according to this embodiment includes two heads 101 and a head holder 102 on which the heads 101 are joined with adhesive. Note that the heads 101 may include intermediate members via which the heads 101 are mounted on the head holder 102. In some embodiments, the number of heads 101 held by the single head holder 102 may be one, or three or more.

Figure 3:
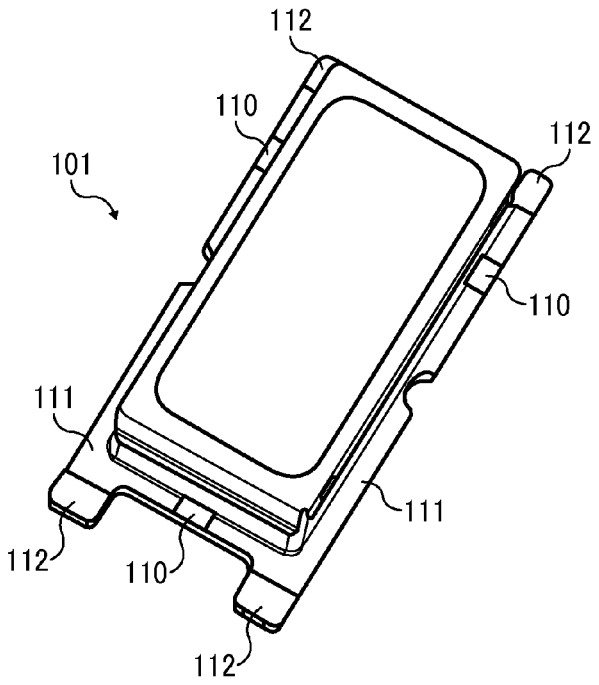
FIG. 3 is a perspective view of a head to be joined with a head holder in the head device, seen from a joined face of the head.
Figure 4:
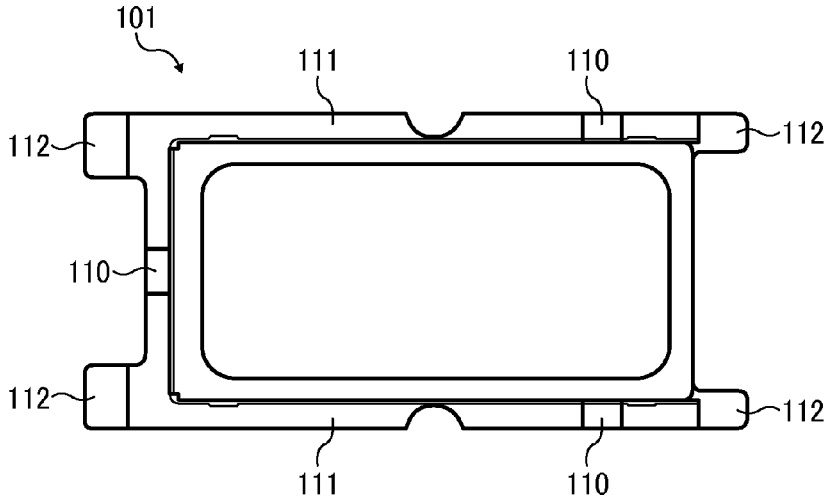
FIG. 4 is a plan view of the head of FIG. 3.
Figure 5:
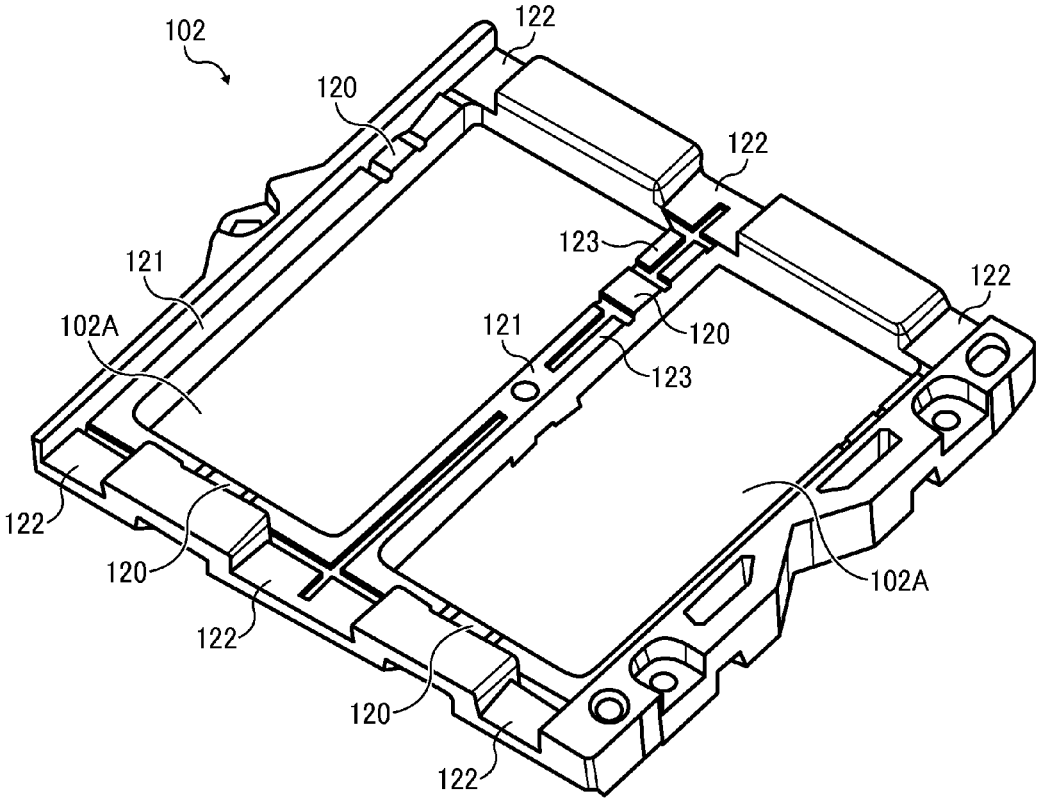
FIG. 5 is a perspective view of the head holder seen from a holding face of the head holder.
Figure 6:
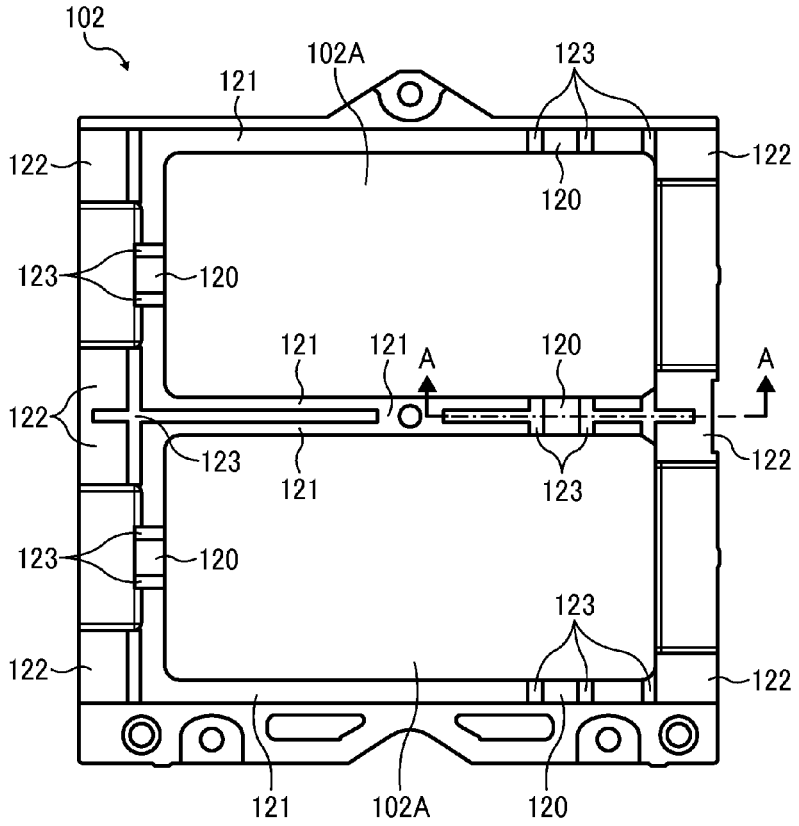
FIG. 6 is a plan view of the head holder.
Figure 7:
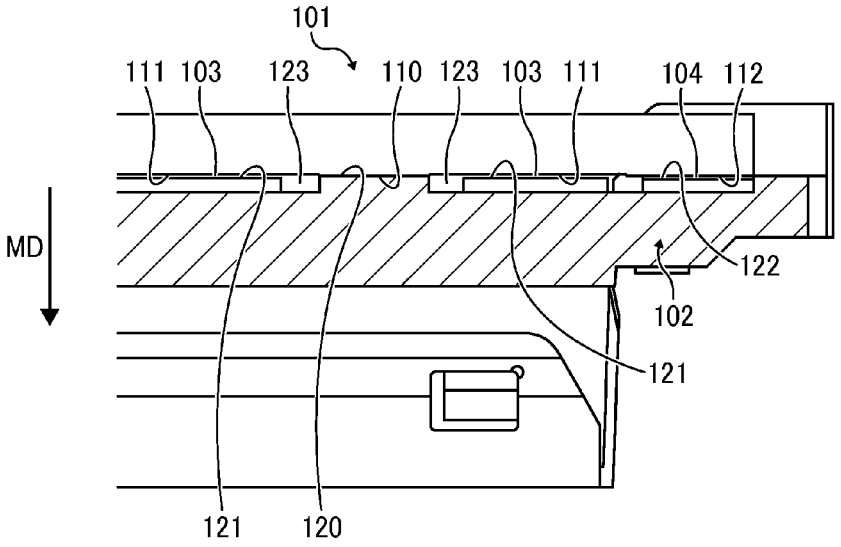
FIG. 7 is a cross-sectional view of a joined state of the head and the head holder cut along line A-A of FIG. 6.
Figure 8:
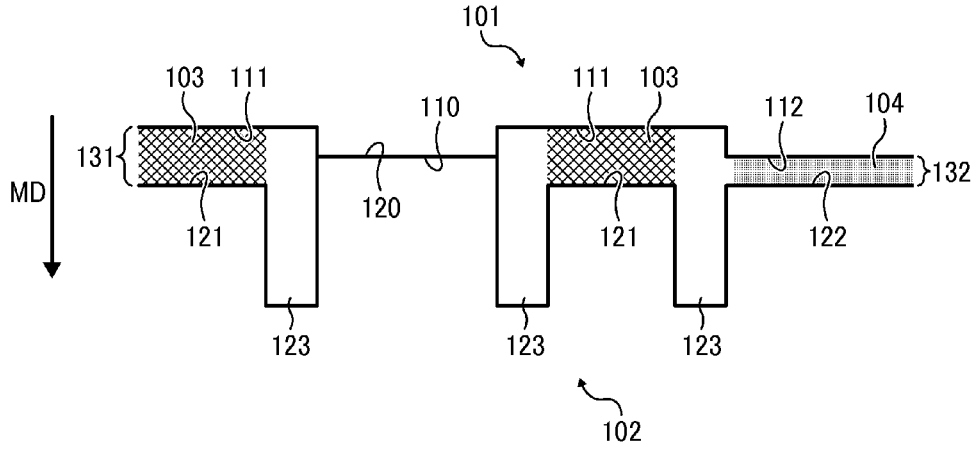
FIG. 8 is an enlarged view of a portion including a reference face, a first space, and a second space illustrated in FIG. 7.
Figure 9:
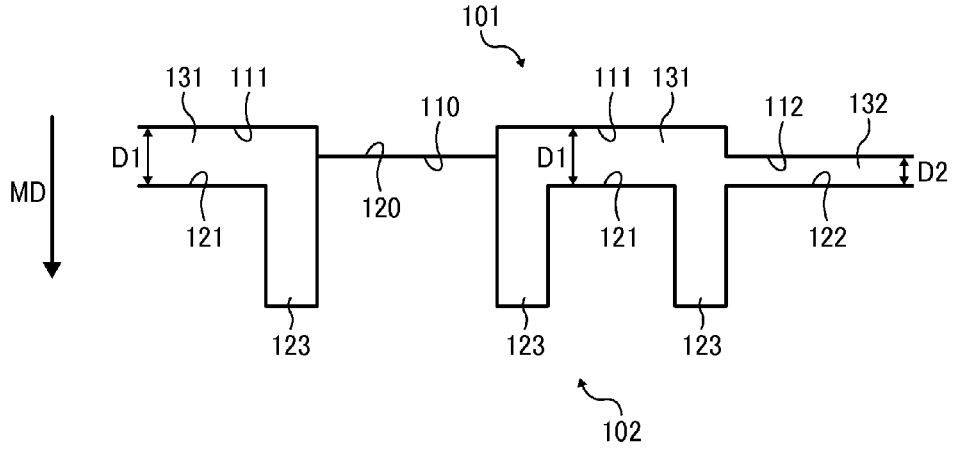
FIG. 9 is an enlarged view of the portion illustrated in FIG. 8 from which adhesive of the first face and the second space is omitted.
Figure 10:
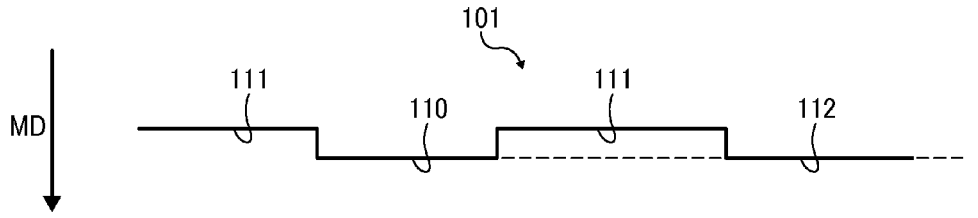
FIG. 10 is an illustration of relative positions of a reference face, a first opposing face, and a second opposing face of the head.
Figure 11:
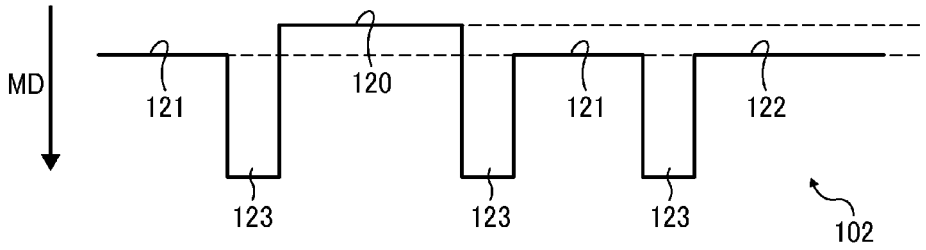
FIG. 11 is an illustration of relative positions of a reference face, a first opposing face, and a second opposing face of the head holder.

Next, an example of the joining structure of the heads and the head holder is described with reference to FIGS. 3 through 10. FIG. 3 is a perspective view of the head seen from its joined face side thereof. FIG. 4 is a plan view of the head illustrated in FIG. 3. FIG. 5 is a perspective view of the head holder seen from a holding face thereof. FIG. 6 is a plan view of the head holder illustrated in FIG. 5. FIG. 7 is a cross-sectional view of a joined state of the head and the head holder cut along line A-A of FIG. 6. FIG. 8 is an enlarged view of a portion including a reference face, a first space, and a second space illustrated in FIG. 7. FIG. 9 is an enlarged view of the portion illustrated in FIG. 8 from which adhesive of the first face and the second space is omitted. FIG. 10 is an illustration of relative positions of a reference face, a first opposing face, and a second opposing face of the head. FIG. 11 is an illustration of relative positions of a reference face, a first opposing face, and a second opposing face of the head holder.

As described above, to obtain a sufficient joining strength when a head and a head holder are fixed with adhesive, for example, the head and the head holder are positioned and temporarily fixed, and then fixed with an adhesive capable of providing a greater joining strength.

In such joining, an adhesive for temporary fixing may be applied around the head and increase an amount of the adhesive adhering to the outside of joined faces of the head and the head holder.

At least one embodiment of this disclosure reduces the amount of the adhesive adhering to the outside of joined faces of a head and a head holder.

A head 101 is inserted into an opening 102A of the head holder 102, and as illustrated in FIG. 8, is joined to the opening 102A with adhesive 103 and adhesive 104.

Here, the head 101 and the head holder 102 have a head-side reference face 110 and a holder-side reference face 120, respectively, which contact with each other.

Here, with the head 101 joined to the head holder 102 via adhesive 103 and the adhesive 104, the head-side reference face 110 and the holder-side reference face 120 contact with each other. As described above, in this embodiment, no adhesive intervenes between the head-side reference face 110 and the holder-side reference face 120. Such a configuration prevents inclination of the head-side reference face 110 and the holder-side reference face 120 or inclination of a nozzle formation face due to the intervention of adhesive.

The head 101 and the head holder 102 have a first opposing face 111 and a first opposing face 121 that oppose with each other to form a first space 131.

The head 101 and the head holder 102 also have a second opposing face 112 and a second opposing face 122 that oppose with each other to form a second space 132.

A distance D2 in a mounting direction MD of the second space 132 formed between the second opposing face 112 and the second opposing face 122 is smaller than a distance D1 in the mounting direction MD of the second space 132 formed between the first opposing face 111 and the first opposing face 121.

In other words, the mounting direction MD represents a contact direction in which the head-side reference face 110 of the head 101 is brought into contact with the holder-side reference face 120 of the head holder 102, in other words, a direction in which the head 101 is inserted into the opening 102A of the head holder 102.

In this embodiment, for the head 101, one of the head and the head holder, the head-side reference face 110 and the second opposing face 112 are arranged at the same position in the mounting direction. The first opposing face 111 is disposed at a position to form a recess relative to the head-side reference face 110 in the mounting direction.

For the head holder 102, the other of the head and the head holder, the first opposing face 121 and the second opposing face 122 are arranged at the same position in the mounting direction, at which the first opposing face 121 and the second opposing face 122 form recesses relative to the holder-side reference face 120 in the mounting direction.

Accordingly, in a state in which the head-side reference face 110 of the head 101 contacts the holder-side reference face 120 of the head holder 102, the distance D2 between the second opposing face 112 and the second opposing face 122 is smaller than the distance D1 between the first opposing face 111 and the first opposing face 121.

The head holder 102 has grooves 123, into which adhesive escapes, at a border portion between the holder-side reference face 120 and the first opposing face 121 and a border portion between the first opposing face 121 and the second opposing face 122.

In such a configuration, when the head 101 is joined to the head holder 102 with adhesive, for example, ultraviolet curing adhesive is used as the adhesive 104 to be filled in the second space 132 and thermosetting adhesive is used as the adhesive 103 to be filled in the first space 131.

In other words, the adhesive 103 filled in the first space 131 and the adhesive 104 filled in the second space 132 are different in type from each other.

In this embodiment, the adhesive 104 filled in the second space 132 is faster in curing rate than the adhesive 103 filled in the first space 131.

Here, a reason why the adhesive 104 faster in curing rate is filled in the second space 132 having a smaller gap width than the first space 131 is that, by reducing the thickness of the adhesive 104 filled, the adhesive 104 is cured faster to suppress variations between components with respect to the time needed until the adhesive 103 for final joining cures.

Accordingly, for example, the head 101 and the head holder 102 are positioned and the adhesive 104 of ultraviolet curing type is cured by ultraviolet light, thus allowing the head 101 and the head holder 102 to be fixed at predetermined relative positions.

Then, curing the adhesive 103 of thermosetting type can secure a sufficient joining strength between the head 101 and the head holder 102.

At this time, the adhesive 103 and the adhesive 104 are filled in the first space 131 and the second space 132, respectively, formed in the opposing faces of the head 101 and the head holder 102, thus suppressing the adhesion of the adhesives to the outside of the head 101.

In the longitudinal direction of the head 101 (a nozzle array direction in which nozzles are arrayed in line), the first opposing faces 111 of the head 101 are interposed between the second opposing faces 112 formed at both ends of the head 101. Likewise, in the longitudinal direction of the head 101, the first opposing faces 121 of the head holder 102 are interposed between the second opposing faces 122 formed at both ends of the head holder 102.

Here, the second opposing faces 112 of the head 101 and the second opposing faces 122 of the head holder 102 are fixed to each other with the adhesive 104, which is faster in curing rate than the adhesive 103. Accordingly, before the first opposing faces 111 of the head 101 and the first opposing faces 121 of the head holder 102 are fixed to each other with the adhesive 103, the second opposing faces 112 and the second opposing faces 122 are fixed to each other.

Thus, both ends of the head 101 and the head holder 102 in the longitudinal direction are secured until the adhesive 103 between the first opposing faces 111 and the first opposing faces 121 cures. Accordingly, the head 101 can be fixed to the head holder 102 with the first opposing faces 111, the second opposing faces 112, and the head-side reference faces 110 of the head 101 being maintained at predetermined positions relative to the first opposing faces 121, the second opposing faces 122, and the holder-side reference faces 120 of the head holder 102.

In this embodiment, the head holder 102 has the grooves 123, into which adhesive escapes, at the border portion between the holder-side reference face 120 and the first opposing face 121 and the border portion between the first opposing face 121 and the second opposing face 122. Such a configuration reliably suppresses overflow of the adhesive 103 and the adhesive 104. Note that the depth of each groove 123 is greater than that of the first space 131.

Figure 12:
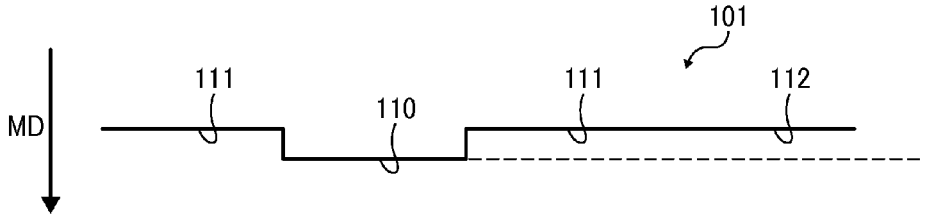
FIG. 12 is an illustration of relative positions of a reference face, a first opposing face, and a second opposing face of a head in a second embodiment of this disclosure.
Figure 13:
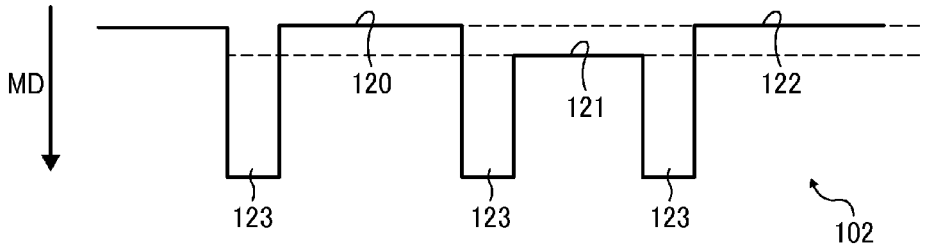
FIG. 13 is an illustration of relative positions of a reference face, a first opposing face, and a second opposing face of a head holder in the second embodiment.

Next, a second embodiment of the present disclosure is described with reference to FIGS. 12 and 13. FIG. 12 is an illustration of relative positions of a reference face, a first opposing face, and a second opposing face of a head in the second embodiment of this disclosure. FIG. 13 is an illustration of relative positions of a reference face, a first opposing face, and a second opposing face of a head holder in the second embodiment.

In contrast with the first embodiment, in the second embodiment, for a head 101, one of the head and the head holder, a first opposing face 111 and a second opposing face 112 are arranged at the same position in a mounting direction indicated by arrow MD. The first opposing face 111 and the second opposing face 112 are disposed at positions to form a recess relative to the head-side reference face 110 in the mounting direction MD.

In this embodiment, for a head holder 102, the other of the head and the head holder, a holder-side reference face 120 and a second opposing face 122 are arranged at the same position in the mounting direction MD. A first opposing face 121 is disposed at a position to form a recess relative to the holder-side reference face 120 in the mounting direction MD.

Accordingly, in a state in which the head-side reference face 110 of the head 101 contacts the holder-side reference face 120 of the head holder 102, a distance between the second opposing face 112 and the second opposing face 122 is smaller than a distance between the first opposing face 111 and the first opposing face 121.

Other configurations and actions are performed similarly to those of the first embodiment.

Figure 14:
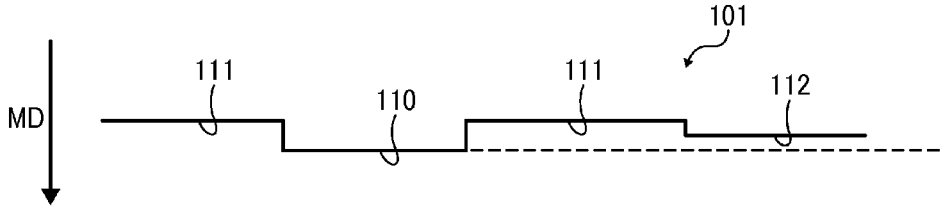
FIG. 14 is an illustration of relative positions of a reference face, a first opposing face, and a second opposing face of a head in a third embodiment of this disclosure.
Figure 15:
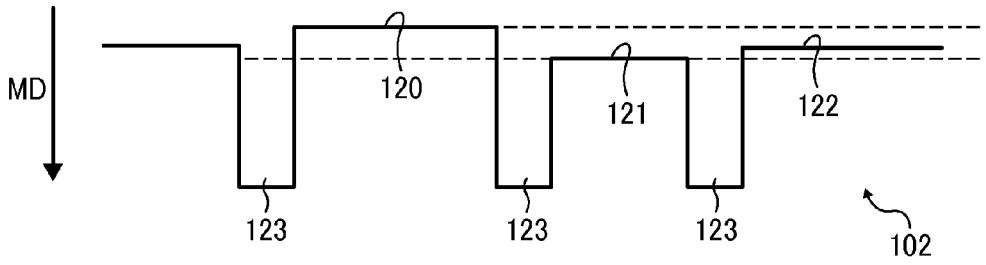
FIG. 15 is an illustration of relative positions of a reference face, a first opposing face, and a second opposing face of a head holder in the third embodiment.

Next, a third embodiment of the present disclosure is described with reference to FIGS. 14 and 15. FIG. 14 is an illustration of relative positions of a reference face, a first opposing face, and a second opposing face of a head in the third embodiment of this disclosure. FIG. 15 is an illustration of relative positions of a reference face, a first opposing face, and a second opposing face of a head holder in the third embodiment.

In this embodiment, in each of the head and the head holder, a reference face, a first opposing face, and a second opposing face are arranged at different positions in a mounting direction indicated by arrow MD.

In other words, for a head 101, one of the head and the head holder, a first opposing face 111 and a second opposing face 112 are disposed at positions to form a recess relative to a head-side reference face 110 in the mounting direction MD. The second opposing face 112 is disposed at a position between the head-side reference face 110 and the first opposing face 111 in the mounting direction MD.

For a head holder 102, the other of the head and the head holder, a first opposing face 121 and a second opposing face 122 are disposed at positions to form a recess relative to a holder-side reference face 120 in the mounting direction MD. The second opposing face 122 is disposed at a position between the holder-side reference face 120 and the first opposing face 121 in the mounting direction MD.

Accordingly, in a state in which the head-side reference face 110 of the head 101 contacts the holder-side reference face 120 of the head holder 102, a distance between the second opposing face 112 and the second opposing face 122 is smaller than a distance between the first opposing face 111 and the first opposing face 121.

Other configurations and actions are performed similarly to those of the first embodiment.

Figure 16:
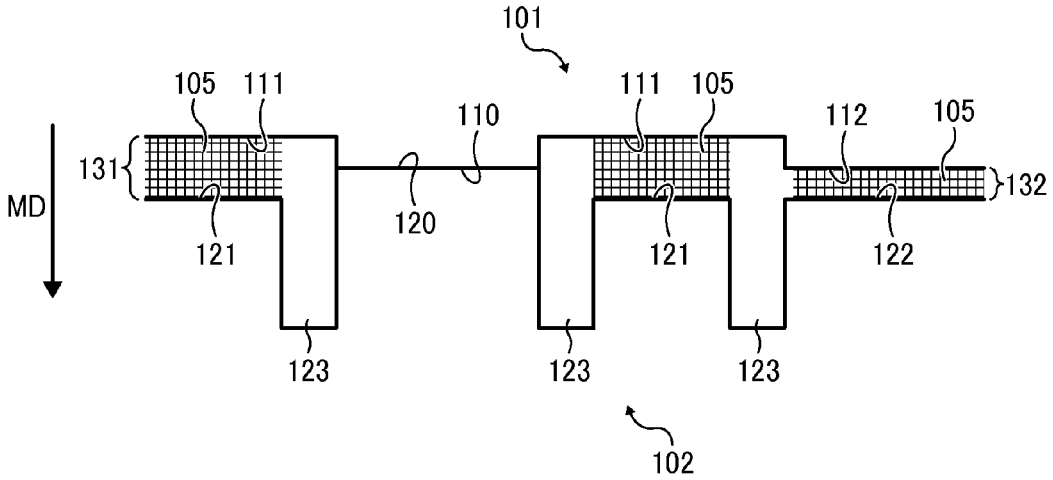
FIG. 16 is an enlarged view of a region including reference faces, a first space, and a second space in a forth embodiment.

Next, a fourth embodiment of the present disclosure is described with reference to FIG. 16. FIG. 16 is an enlarged view of a region including reference faces, a first space, and a second space in the fourth embodiment.

In this embodiment, a first space 131 and a second space 132 are filled with the same adhesive 105.

As described above, the first space 131 and the second space 132 are different in the size of clearance. Accordingly, even if the same adhesive 105 is used, the first space 131 and the second space 132 have different curing times and typically, the adhesive 105 of the second space 132, which has a thinner adhesive layer, can cure earlier than that of the first space 131.

Figure 17:
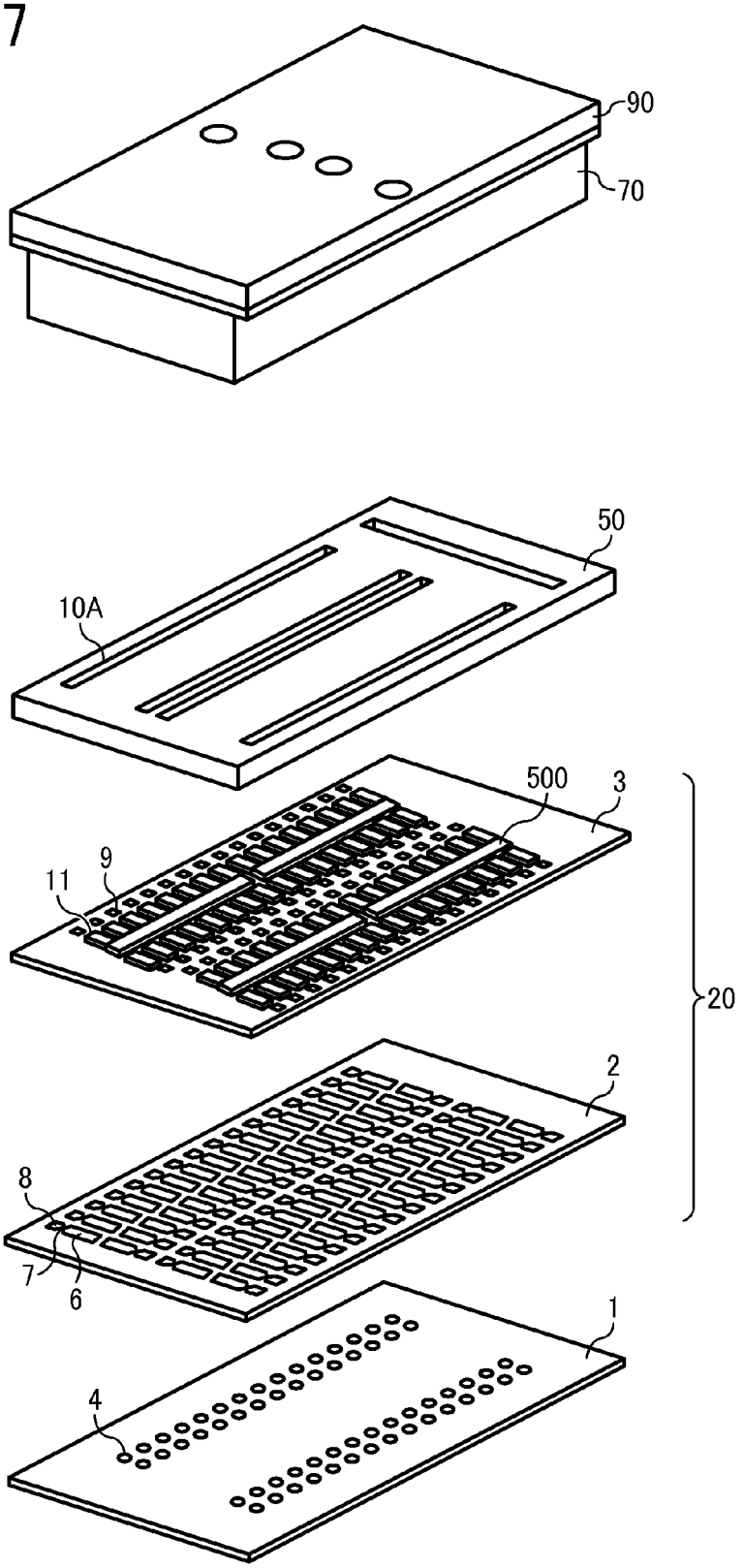
FIG. 17 is an exploded view of an example of a liquid discharge head.
Figure 18:
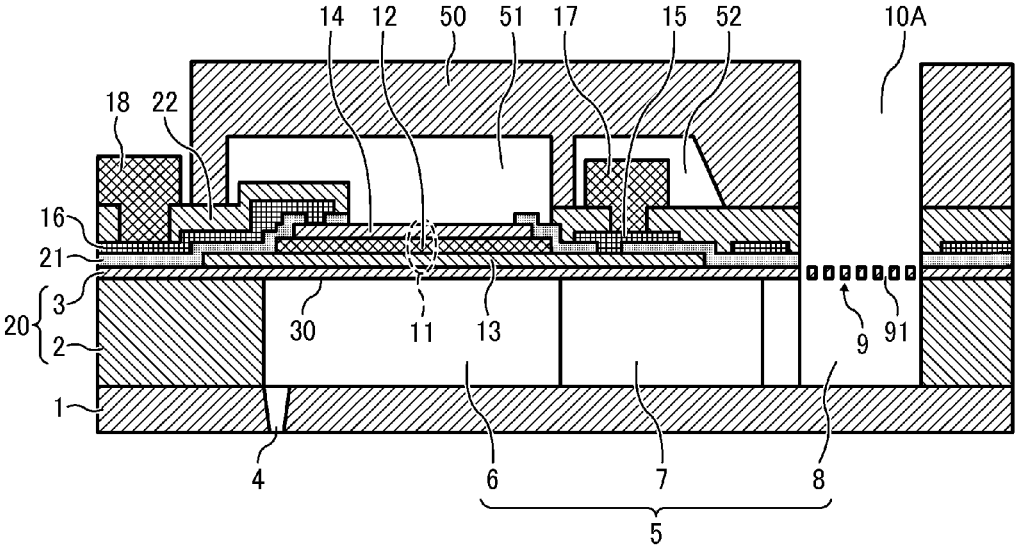
FIG. 18 is a cross-sectional view of a portion of the liquid discharge head of FIG. 17 cut in a direction perpendicular to a nozzle array direction.
Figure 19:
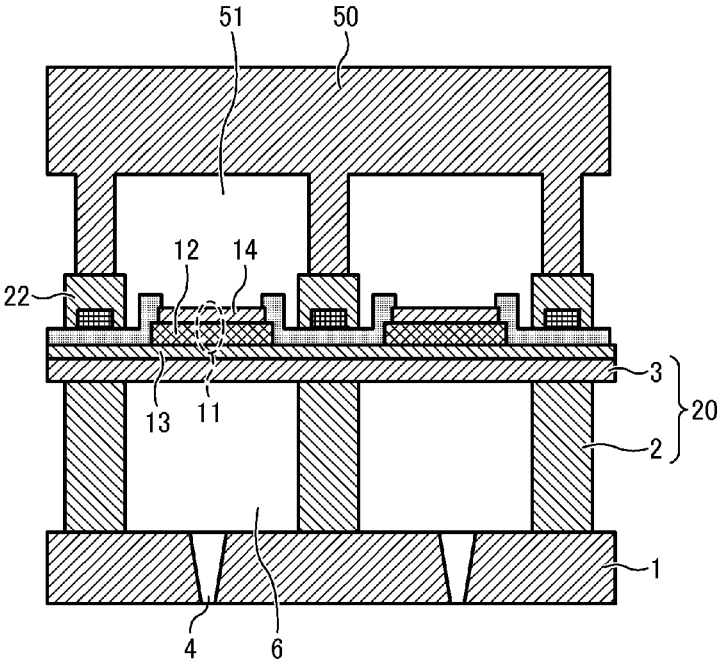
FIG. 19 is a cross-sectional view of a portion of the liquid discharge head cut in the nozzle array direction.

Next, an example of a liquid discharge head constituting the head 101 according to an embodiment of this disclosure is described with reference to FIGS. 17 through 19. FIG. 17 is an exploded view of the liquid discharge head in this embodiment. FIG. 18 is a cross-sectional view of a portion of the liquid discharge head cut in a direction perpendicular to a nozzle array direction. FIG. 19 is a cross-sectional view of a portion of the liquid discharge head cut in the nozzle array direction.

The liquid discharge head of FIGS. 17 through 19 includes a nozzle plate 1, a channel plate 2, a diaphragm plate 3, a piezoelectric element 11 serving as a pressure generator, a holding board 50, and a frame 70 also serving as a common chamber substrate. Note that, in this embodiment, a portion including the channel plate 2, the diaphragm plate 3, and the piezoelectric element 11 is referred to as an actuator board 20. However, it does not mean that the nozzle plate 1, the holding board 50, and the frame 70 are joined to the actuator board 20 after the actuator board 20 is formed as an independent component.

The nozzle plate 1 is provided with a plurality of nozzles 4 to discharge liquid droplets. In this embodiment, the nozzles 4 are arrayed in four rows.

With the nozzle plate 1 and the diaphragm plate 3, the channel plate 2 forms individual liquid chambers 6 communicated with nozzles 4, fluid resistance portions 7 communicated with the individual liquid chambers 6, and liquid inlets (channels) 8 communicated with the fluid resistance portion 7. The individual liquid chamber 6, the fluid resistance portion 7, and the liquid inlet 8 form an individual channel 5.

The liquid inlets 8 are communicated with a common liquid chamber 10 formed with opening portions 10A of the holding board 50 and the frame 70, via filters 9 formed in the diaphragm plate 3. The opening portions 10A are part of the common liquid chamber 10. The filters 9 include one or more filter holes 91.

The diaphragm plate 3 forms a deformable vibration portion 30 forming part of a wall of the individual liquid chamber 6. The piezoelectric element 11 is disposed integrally with the vibration portion 30 on a face of the vibration portion 30 opposite the individual liquid chamber 6. The vibration portion 30 and the piezoelectric element 11 form a piezoelectric actuator.

In the piezoelectric element 11, layers forming a lower electrode 13, a piezoelectric layer (piezoelectric body) 12, and an upper layer 12 are laminated in this order from the vibration portion 30. An interlayer dielectric film 21 is formed on the piezoelectric element 11.

The lower electrode 13 of the piezoelectric element 11 is led out via a common wiring 15 and connected to a connection pad 17. The upper electrode 14 is led out via an individual wiring 16 and connected to a connection pad 18 and a driver integrated circuit (IC).

The driver IC is mounted on the actuator board 20 by, e.g., flip chip bonding or wire bonding, so as to cover regions between rows of piezoelectric elements.

The holding board 50 is disposed on the actuator board 20 via a passivation layer 22. The holding board 50 includes a wiring space 52 and a recessed portion (vibration chamber) 51 to accommodate the piezoelectric element 11.

The holding board 50 also includes the opening portions 10A that are part of the common liquid chamber as described above. The holding board 50 is joined to a side of the actuator board 20 facing the diaphragm plate 3 with adhesive.

For the liquid discharge head thus configured, by applying a voltage between the upper electrode 14 and the lower electrode 13 of the piezoelectric element 11 from the driver IC, the piezoelectric layer 12 extends in an electrode lamination direction, in other words, an electric-field direction and contracts in a direction parallel to the vibration portion 30.

At this time, since the lower electrode 13 is restricted by the vibration portion 30, a tensile stress arises at a side of the vibration portion 30 facing the lower electrode 13. The vibration portion 30 bends toward the individual liquid chamber 6 and pressurizes internal liquid, thus discharging droplets from the nozzles 4.

Figure 20:
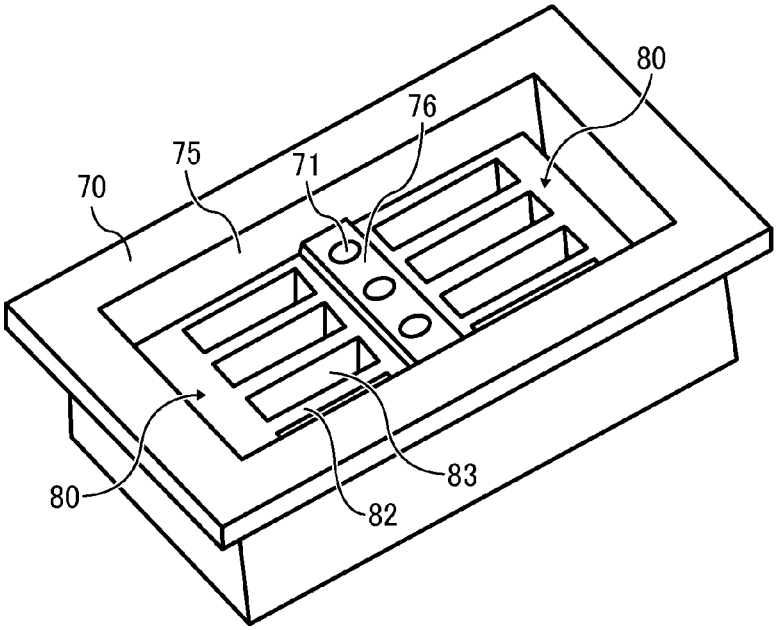
FIG. 20 is a perspective view of an example of a frame along a nozzle array direction of FIG. 20.
Figure 21:
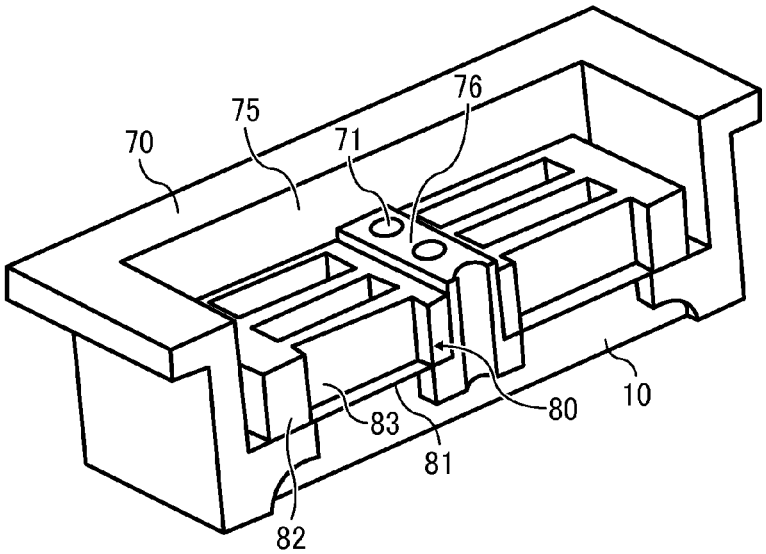
FIG. 21 is a cross-sectional perspective view of the frame along the nozzle array direction of FIG. 20.

Next, an example of the frame is described with reference to FIGS. 20 and 21. FIG. 20 is a perspective view of an example of the frame. FIG. 21 is a perspective cross-sectional view of the frame along a nozzle array direction of FIG. 20.

A frame 70 is joined to a face of the actuator board 20 opposite a face joined to the nozzle plate 1, and forms the common liquid chamber 10 that supplies liquid to the plurality of individual liquid chambers 6, to which the plurality of nozzles 4 that discharges liquid droplets communicate. The frame 70 includes a concave portion serving as the common liquid chamber 10.

In addition, the frame 70 includes a recessed portion 75 serving as a damper chamber to accommodate damper members 80.

The frame 70 includes a joint tube 76 that forms at least a part of the supply tubes to supply liquid to the common liquid chamber 10 from outside. The joint tube 76 is disposed in the center of the recessed portion 75 in a longitudinal direction of the common liquid chamber 10 which is a nozzle array direction. The joint tube 76 includes a liquid supply channel 71.

Each of the damper members 80 is disposed in an area between a wall of the joint tube 76 of the frame 70 and a side wall of the recessed portion 75, in the longitudinal direction of the common liquid chamber 10.

The damper member 80 includes a damper 81 and a holder 82. The damper 81 is deformable to recover an original shape and forms part of a wall of the common liquid chamber 10 opposite a face of the common liquid chamber 10 facing the individual liquid chamber 6. The holder 82 is joined to the damper 81 to hold the damper 81. The holder 82 includes openings 83 (being part of the damper chamber) to allow deformation of the damper 81.

A channel switching member 90 is joined to an opening side of the recessed portion 75 of the frame 70.

The joint tube 76 of the frame 70 is connected to a joint tube of the channel switching member 90 via a packing.

The frame 70 includes the head-side reference face 110, the first opposing face 111, and the second opposing face 112.

Figure 22:
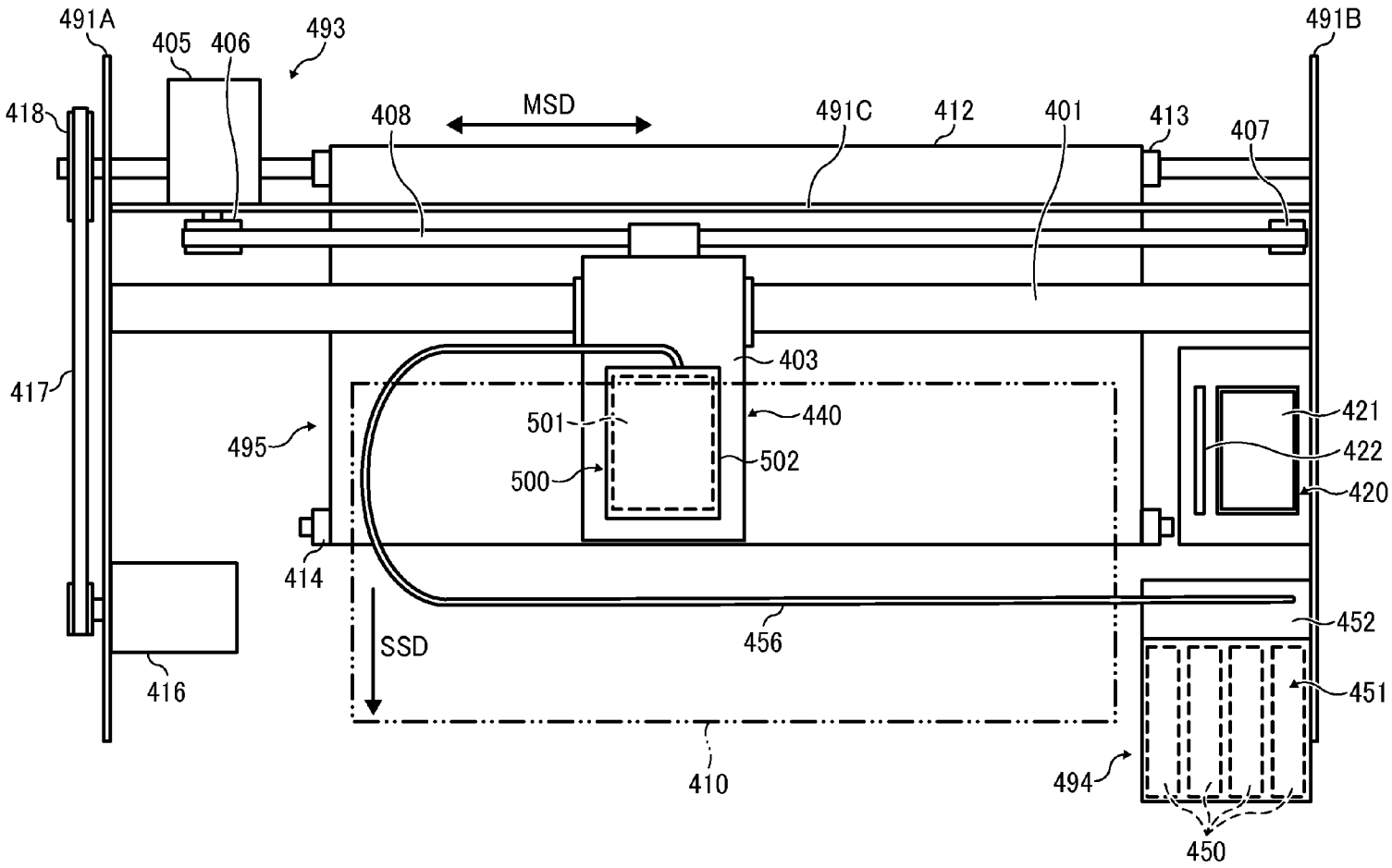
FIG. 22 is a plan view illustrating a portion of a liquid discharge apparatus according to an embodiment of this disclosure.
Figure 23:
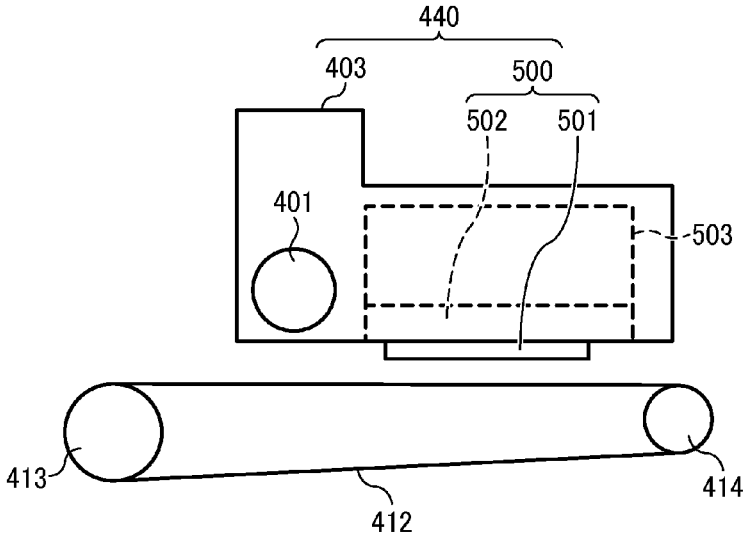
FIG. 23 is a side view of the liquid discharge apparatus of FIG. 22.

Next, a liquid discharge apparatus according to an embodiment of the present disclosure is described with reference to FIGS. 22 and 23. FIG. 22 is an explanatory plan view illustrating a portion of the liquid discharge apparatus, and FIG. 23 is an explanatory side view of the same.

A liquid discharge apparatus 1000 according to this embodiment is a serial-type apparatus so that a carriage 403 reciprocally moves with a main scan moving unit 493 in a main scanning direction indicated by arrow MSD. The main scan moving unit 493 includes a guide 401, a main scan motor 405, a timing belt 408, and the like. The guide 401 is held on right and left side plates 491A, 491B and supports the carriage 403 to be movable. The main scan motor 405 moves the carriage 403 reciprocally in the main scanning direction MSD via a timing belt 408 stretched between a driving pulley 406 and a driven pulley 407.

The carriage 403 mounts a head device 500 according to an embodiment of the present disclosure. The head device 500 includes a liquid discharge head 501 serving as a head to discharge liquid and a head holder 502 mounting the liquid discharge head 501.

The liquid discharge head 501 of the head device 500 discharges ink droplets of each color of, for example, yellow (Y), cyan (C), magenta (M), and black (K). The liquid discharge head 501 includes nozzle arrays formed of a plurality of nozzles arranged in a sub-scanning direction indicated by arrow SSD in FIG. 22 perpendicular to the main scanning direction MSD, with the liquid discharge head 501 oriented downward.

The head device 500 and the carriage 403 integrally form a liquid discharge device 440 according to this embodiment.

The liquid stored outside the liquid discharge head 501 is supplied to the liquid discharge head 501 via a supply unit 494 that supplies the liquid from a liquid cartridge 450.

The supply unit 494 includes a cartridge holder 451 to mount the liquid cartridge 450 thereon, a tube 456, and a liquid feed unit 452 including a feed pump. The liquid cartridge 450 is detachably attached to the cartridge holder 451. The liquid is supplied to the liquid discharge head 501 with the liquid feed unit 452 via the tube 456 from the liquid cartridge 450.

In the liquid discharge device 440, for example, the carriage 403 may include a head tank 503 to store the liquid supplied from the liquid cartridge 450 and supply the liquid to the liquid discharge head 501.

The liquid discharge apparatus 1000 includes a conveying unit 495 to convey a sheet 410. The conveying unit 495 includes a conveyance belt 412, and a sub-scanning motor 416 to drive the conveyance belt 412.

The conveyance belt 412 electrostatically attracts the sheet 410 and conveys the sheet 410 at a position facing the liquid discharge head 501. The conveyance belt 412 is an endless belt and is stretched between a conveyance roller 413 and a tension roller 414. The sheet 410 is attracted to the conveyance belt 412 due to an electrostatic force or by air aspiration.

The conveyance roller 413 is rotated with the sub scanning motor 416 via a timing belt 417 and a timing pulley 418, so that the conveyance belt 412 circulates in the sub-scanning direction SSD.

Further, a maintenance unit 420 to maintain and recover the liquid discharge head 501 in good condition is disposed on a lateral side of the conveyance belt 412 at one side in the main scanning direction MSD of the carriage 403.

The maintenance unit 420 includes, for example, a cap 421 to cap a nozzle face (i.e., a face on which nozzles are formed) of the liquid discharge head 501 and a wiper 422 to clean the nozzle face.

The main scan moving unit 493, the supply unit 494, the maintenance unit 420, and the conveying unit 495 are disposed to a housing that includes the side plates 491A, 491B, and a rear plate 491C.

In the thus-configured liquid discharge apparatus 1000, a sheet 410 is conveyed on and attracted to the conveyance belt 412 and is conveyed in the sub-scanning direction SSD by circulation of the conveyance belt 412.

Then, the liquid discharge head 501 is driven in response to image signals while the carriage 403 moves in the main scanning direction MSD, to discharge liquid to the sheet 410 stopped, thereby forming an image on the sheet.

As described above, the liquid discharge apparatus includes the liquid discharge head according to this embodiment, thus allowing stable formation of high quality images.

Figure 24:
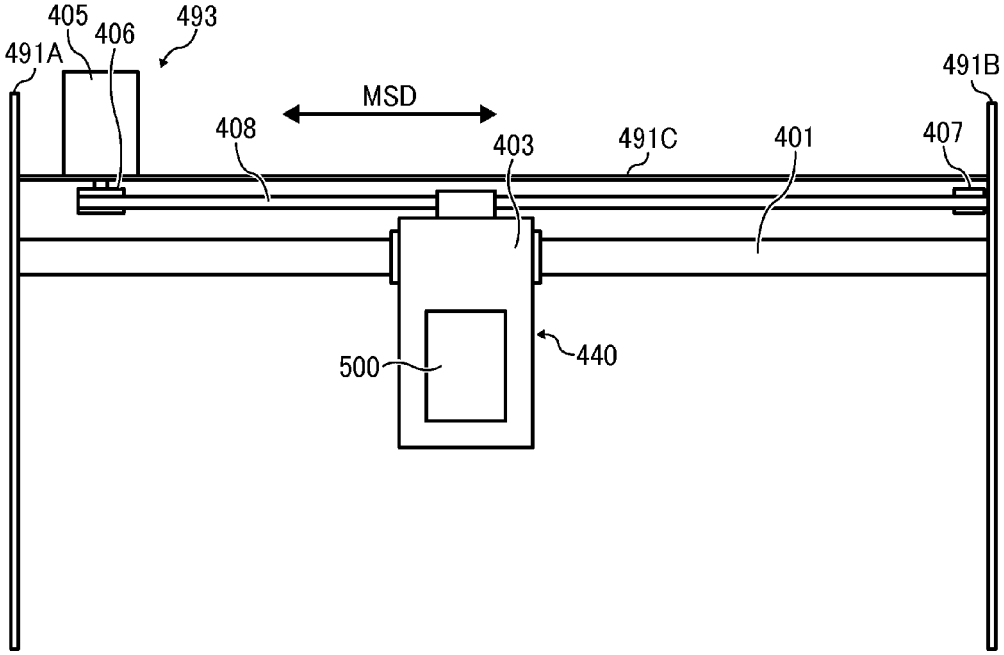
FIG. 24 is a plan view illustrating a portion of a liquid discharge apparatus according to another embodiment of this disclosure.

Next, a liquid discharge device according to another embodiment of the present disclosure is described with reference to FIG. 24. FIG. 24 is a plan view illustrating a portion of the liquid discharge device in this embodiment.

A liquid discharge device 440 according to this embodiment includes a housing formed of side plates 491A and 491B and the rear plate 491C, a main scan moving unit 493, a carriage 403, and a head device 500.

For example, at least one of a maintenance unit 420 and a supply unit 494 may also be mounted on, for example, on the side plate 491B of the liquid discharge device 440.

In this disclosure, the liquid discharge apparatus includes a head device including a liquid discharge head, and drives the liquid discharge head of the head device to discharge liquid. As the liquid discharge apparatus, there are an apparatus capable of discharging liquid to materials on which the liquid can be deposited as well as an apparatus to discharge the liquid toward a space or liquid.

The liquid discharge apparatus may include devices to feed, convey, and eject the material on which the liquid can be deposited. The liquid discharge apparatus may further include a pretreatment apparatus to coat a treatment liquid onto the material, and a posttreatment apparatus to coat the treatment liquid onto the material, onto which the liquid has been discharged.

Exemplary liquid discharge apparatuses may include, for example, an image forming apparatus to form an image on the sheet by discharging liquid, and a three-dimensional apparatus to discharge a molding liquid to a powder layer in which powder material is formed in layers, so as to form a three-dimensional article.

In addition, the liquid discharge apparatus is not limited to such an apparatus to form and visualize images with letters or figures having meaning. Alternatively, the liquid discharge apparatus forms images without meaning such as patterns and three-dimensional objects.

The above materials on which the liquid can be deposited may include any material on which the liquid may be deposited even temporarily. Exemplary materials on which the liquid can be deposited may include paper, thread, fiber, fabric, leather, metals, plastics, glass, wood, ceramics, and the like, on which the liquid can be deposited even temporarily.

In addition, the liquid may include ink, a treatment liquid, DNA sample, resist, pattern material, binder, mold liquid, and the like.

Further, the exemplary liquid discharge apparatuses include, otherwise limited in particular, any of a serial-type apparatus to move the head device and a line-type apparatus not to move the head device.

The exemplary liquid discharge apparatuses include otherwise a treatment liquid coating apparatus to discharge the treatment liquid to the sheet to coat the treatment liquid on the surface of the sheet for the purpose of reforming a sheet surface, and an injection granulation apparatus in which a composition liquid including a raw materials dispersed in the solution is injected with the nozzle to granulate fine particles of the raw material.

The liquid discharge device is an integrated unit in which the head device formed of the head holder mounting the liquid discharge head is integrated with functional parts and other structures, and denotes an assembly of parts relating to the liquid discharge. For example, the liquid discharge device may be formed of a combination of the head device with at least one of a head tank, a carriage, a supply unit, a maintenance unit, and a main scan moving unit.

Herein, examples of integrated unit include a head device plus functional parts, of which structure is combined fixedly to each other through fastening, binding, and engaging, and ones movably held by the other parts. In addition, the head device can be detachably attached to the functional parts or structures each other.

Further another example of the liquid discharge device is the head device integrally formed with the carriage.

Further, as illustrated in FIG. 24, the head device, the carriage, and the main scan moving unit are integrally formed, thereby forming the liquid discharge device.

The pressure generating unit of the liquid discharge head is not limited in particular. For example, other than the piezoelectric actuator (or a layered-type piezoelectric element) as described above, a thermal actuator that employs thermoelectric conversion elements such as a thermal resistor, and an electrostatic actuator formed of a vibration portion and an opposed electrode may be used.

The term "image formation" means not only recording, but also printing, image printing, molding, and the like.

The apparatus according to any of the above-described embodiments is described with reference to the example of liquid discharge apparatus. However, the apparatus according to an embodiment of the present invention is not limited to the liquid discharge apparatus. For example, when a head (e.g., a thermal head) other than the liquid discharge head is used as the head of the head device, the apparatus according to an embodiment of the present invention is, for example, a thermal printer.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A head device, comprising:

a head including a reference face, a first opposing face, and a second opposing face;

a head holder joined to the head, the head holder including a reference face contacting the reference face of the head, a first opposing face opposing the first opposing face of the head to form a first space, and a second opposing face opposing the second opposing face of the head to form a second space;

wherein the first opposing, faces of the head holder and the head, opposing, each other, adhere via adhesive to each other, and the second opposing faces of the head holder and the head, opposing each other, adhere via adhesive to each other, and wherein the second space is smaller than the first space in a mounting direction in which the reference face of the head is brought into contact with the reference face of the head holder, and the head is joined to the head holder with adhesive filled in each of the first space and the second space.

2. The head device according to claim 1, wherein the reference face, the first opposing face, and the second opposing face in each of the head and the head holder are disposed at different positions in the mounting direction.

3. The head device according to claim 1, further comprising a groove disposed at least one of a border between the reference face and the first opposing face of the head holder, a border between the reference face and the second opposing face of the head holder, and a border between the first opposing face and the second opposing face of the head holder.

4. The head device according to claim 1, wherein the adhesive filled in the first space is different in type from the adhesive filled in the second space.

5. The head device according to claim 4, wherein the adhesive filled in the second space is faster in curing speed than the adhesive filled in the first space.

6. The head device according to claim 5, wherein the adhesive filled in the second space is an ultraviolet curing adhesive.

7. The head device according to claim 5, wherein the adhesive filled in the first space is a thermosetting adhesive.

8. An apparatus comprising the head device according to claim 1.

9. A liquid discharge device comprising the head device according to claim 1, wherein the head of the head device is a liquid discharge head to discharge liquid, and the head device is integrated with at least one of a head tank to store the liquid to be supplied to the liquid discharge head of the head device;

a carriage mounting the liquid discharge head;

a supply unit to supply the liquid to the liquid discharge head;

a maintenance unit to maintain and recover the liquid discharge head; and a main scan moving unit to move the liquid discharge head in a main scanning direction.

10. An apparatus for discharging liquid, the apparatus comprising the liquid discharge device according to claim 9.

11. An apparatus for discharging liquid, the apparatus comprising the head device according to claim 1, wherein the head of the head device is a liquid discharge head to discharge liquid.

12. A head device, comprising:

a head including a reference face, a first opposing face, and a second opposing face;

a head holder joined to the head, the head holder including a reference face contacting the reference face of the head, a first opposing face opposing the first opposing face of the head to form a first space, and a second opposing face opposing the second opposing face of the head to form a second space;

wherein the second space is smaller than the first space in a mounting direction in which the reference face of the head is brought into contact with the reference face of the head holder, and the head is joined to the head holder with adhesive filled in each of the first space and the second space, wherein, in one of the head and the head holder, the reference face and the second opposing face are disposed at an identical position in the mounting direction and the first opposing face is disposed at a position to form a recess relative to the reference face, and wherein, in the other of the head and the head holder, the first opposing face and the second opposing face are disposed at an identical position in the mounting direction to form a recess relative to the reference face.

13. An apparatus comprising the head device according to claim 2.

14. A liquid discharge device comprising the head device according to claim 2, wherein the head of the head device is a liquid discharge head to discharge liquid, and the head device is integrated with at least one of a head tank to store the liquid to be supplied to the liquid discharge head of the head device;

a carriage mounting the liquid discharge head;

a supply unit to supply the liquid to the liquid discharge head;

a maintenance unit to maintain and recover the liquid discharge head; and a main scan moving unit to move the liquid discharge head in a main scanning direction.

15. An apparatus for discharging liquid, the apparatus comprising the liquid discharge device according to claim 14.

16. An apparatus for discharging liquid, the apparatus comprising the head device according to claim 2, wherein the head of the head device is a liquid discharge head to discharge liquid.

* * * * *